US007353892B2

(12) United States Patent
Klaiber et al.

(10) Patent No.: US 7,353,892 B2
(45) Date of Patent: Apr. 8, 2008

(54) GUIDE FRAME FOR AN EARTH DRILLING APPARATUS

(75) Inventors: Jochen Klaiber, Waiblingen (DE); Klaus-Martin Uhl, Plochingen (DE)

(73) Assignee: Andreas Stihl AG & Co., KG, Waiblingen (DE)

( * ) Notice: Subject to any disclaimer, the term of this patent is extended or adjusted under 35 U.S.C. 154(b) by 309 days.

(21) Appl. No.: 11/206,018

(22) Filed: Aug. 18, 2005

(65) Prior Publication Data

US 2006/0048974 A1 Mar. 9, 2006

(30) Foreign Application Priority Data

Sep. 3, 2004 (DE) ..... 10 2004 043 195

(51) Int. Cl.
*E21B 10/44* (2006.01)
*E21B 12/06* (2006.01)

(52) U.S. Cl. ..... 175/394; 172/22; 172/25

(58) Field of Classification Search ..... None
See application file for complete search history.

(56) References Cited

U.S. PATENT DOCUMENTS 4,102,410 A * 7/1978 Ross ..... 173/133
4,402,369 A * 9/1983 Nikitin et al. ..... 173/18
4,476,940 A * 10/1984 Reichert et al. ..... 173/37
4,947,938 A * 8/1990 Fricke et al. ..... 172/22
5,358,062 A 10/1994 Uhl et al.

FOREIGN PATENT DOCUMENTS

GB 2233994 1/1991

* cited by examiner

*Primary Examiner*—Frank Tsay
(74) *Attorney, Agent, or Firm*—Walter Ottesen

(57) ABSTRACT

A guide frame (1) for an earth drilling apparatus includes a support plate (6) for holding the drive unit (7) and a handle frame (2) having handle sections (17, 18) for holding and guiding the earth drilling apparatus. Operator-controlled elements (19*a*, 19*b*, 19*c*) for controlling the drive unit (7) are arranged in the region of the handle section (18). The handle sections (17, 18) of the handle frame (2) lie in a plane (5) above the support plate (6). The handle frame (2) encloses the drive unit (7) as a closed frame and is connected via a carrier frame (8) to the support plate (6). The carrier plate (8) is fixed to the handle frame (2) via several coupling elements (20). Each coupling element (20) includes a vibration damper (24) which is arranged between the carrier frame (8) and the handle frame (2). In this way, the handle frame is decoupled by the carrier frame from the drive unit with respect to vibration without affecting the bracing of reaction forces via the handle frame.

20 Claims, 5 Drawing Sheets

Fig. 1
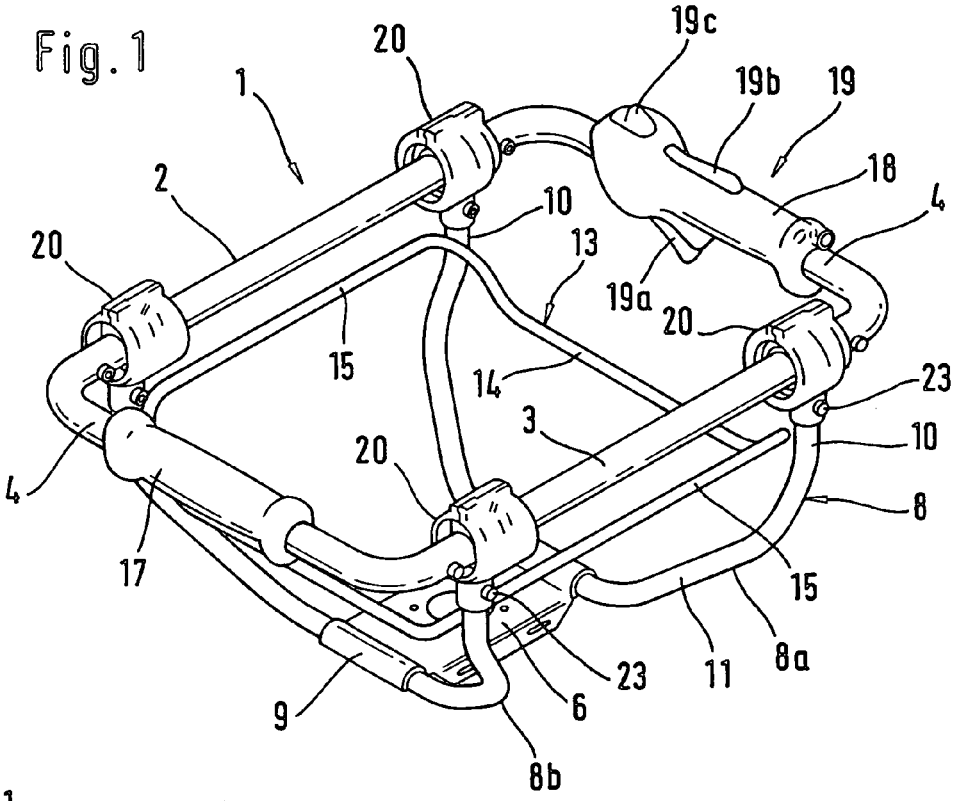
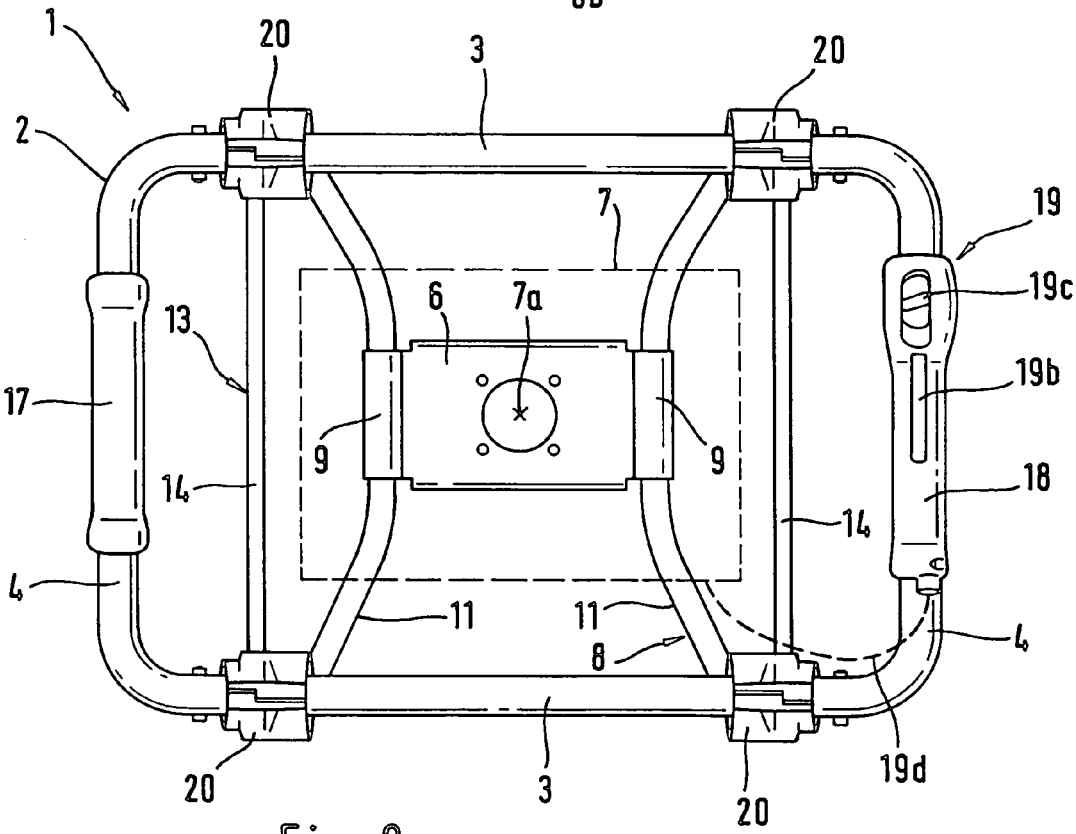
Fig. 2

Fig. 3
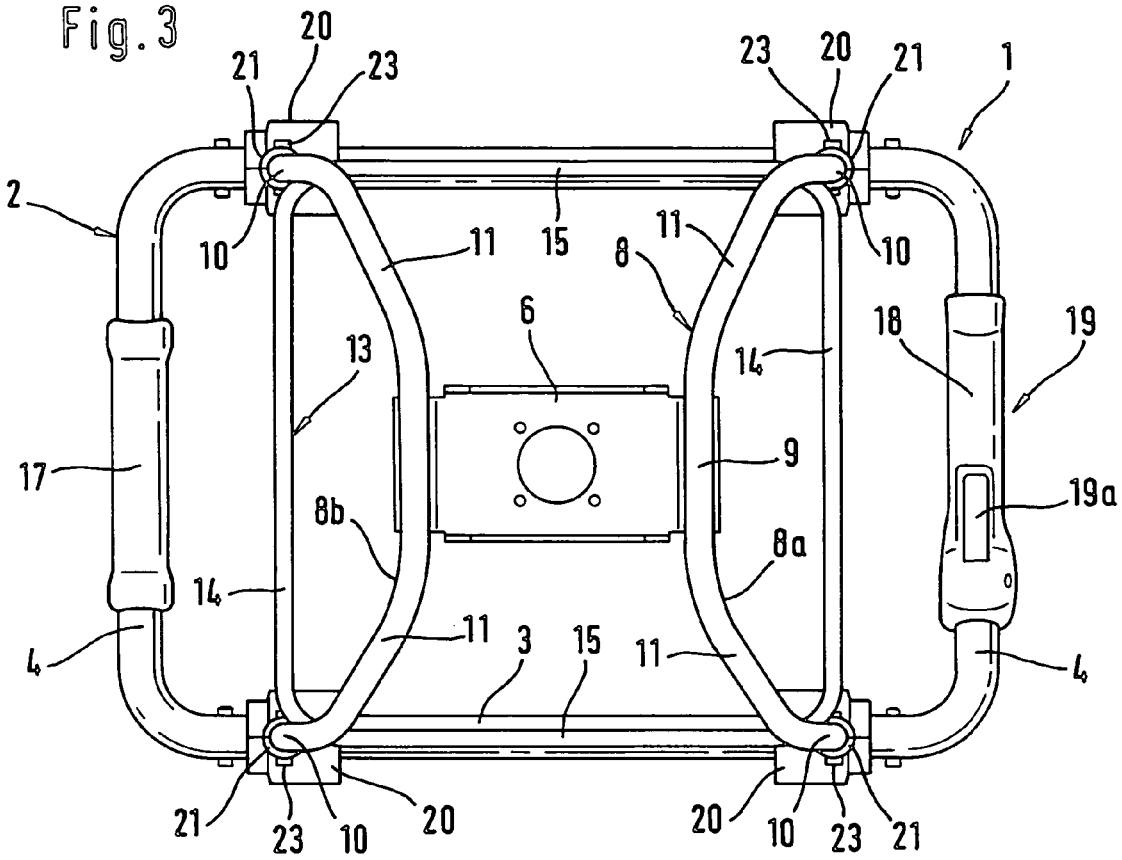
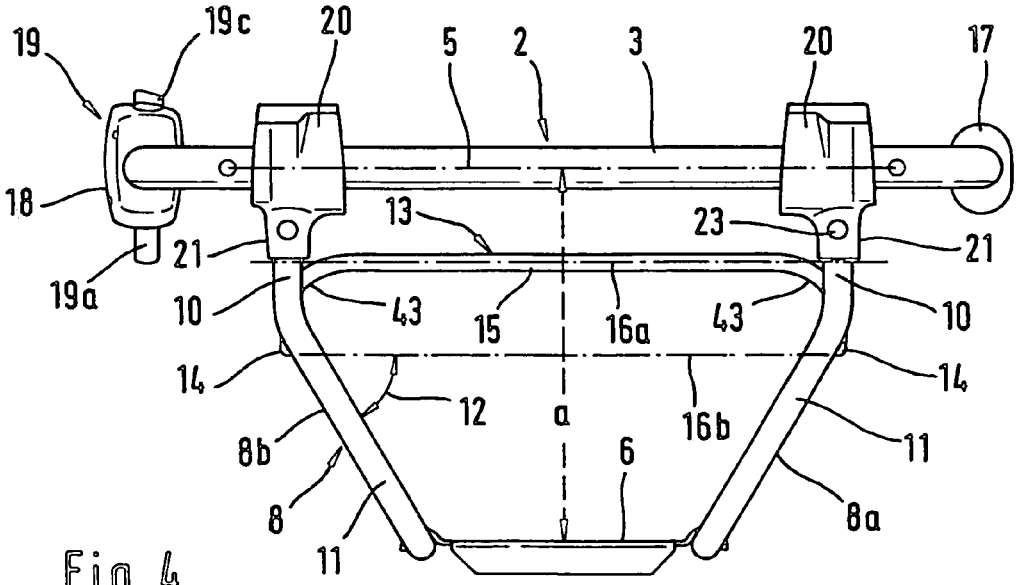
Fig. 4

GUIDE FRAME FOR AN EARTH DRILLING APPARATUS

CROSS REFERENCE TO RELATED APPLICATION

This application claims priority of German patent application no. 10 2004 043 195.7, filed Sep. 3, 2004, the entire content of which is incorporated herein by reference.

FIELD OF THE INVENTION

The invention relates to a guide frame for a hand-guided work apparatus and especially an earth drilling apparatus or the like. The guide frame includes a carrier plate for holding the drive unit on the guide frame and a handle frame having handle sections for holding and guiding the work apparatus. The guide frame also includes an operator-controlled element mounted in the region of one of the handle sections and provided for controlling the drive unit. The handle sections of the handle frame lie in a plane above the carrier plate.

BACKGROUND OF THE INVENTION

An earth drilling apparatus of the kind described above is disclosed in U.S. Pat. No. 5,358,062. The guide frame together with the handle frame defines a steering unit having a center region wherein the drive unit, for example, an internal combustion engine, is mounted. An earth auger is driven via a gear assembly. The operator has to brace against the reaction torque via the handle sections and the handle frame.

A drilling apparatus for making golf holes is known from British patent application 2,233,994 A1. The support plate, which holds the drive unit, has handle brackets on opposite-lying sides which run upwardly at an angle. The drive unit projects beyond the ends of the handle brackets in elevation and this is disturbing to the operator when utilizing this known earth drilling apparatus.

The known earth drilling apparatus connects the drive unit directly to the handle frame so that the operator is subjected to considerable vibration loads during operation.

SUMMARY OF THE INVENTION

It is an object of the invention to provide a guide frame for work apparatus which, on the one hand, permits the operator to work effectively and, on the other hand, keeps the vibrations, which are generated by the drive unit, away from the handle frame without affecting the support or bracing of reaction forces.

The guide frame of the invention is for a handheld work apparatus having a drive unit. The guide frame includes: a support plate for holding the drive unit on the guide frame; a handle frame having handle sections to permit an operator to hold and guide the work apparatus; an operator-controlled element arranged in the region of at least one of the handle sections for controlling the drive unit; the handle sections conjointly defining a handle plane disposed above the support plate; the handle frame being a closed frame surrounding the drive unit; a carrier frame; the handle frame being connected via the carrier frame to the support plate; the handle frame having a plurality of coupling elements disposed thereon for attaching the carrier frame to the handle frame; and, each of the coupling elements including a vibration damper arranged between the carrier frame and the handle frame.

The handle frame of the guide frame of the invention surrounds the drive unit as a closed frame so that the drive unit lies within the handle frame. The handle frame is connected to the support plate via a carrier frame. The support plate lies at a spacing relative to the handle frame because of the carrier frame. The carrier frame is fixed via coupling elements on the handle frame. Each of the coupling elements includes a vibration damper which is arranged between the carrier frame and the handle frame in order to so ensure a decoupling of vibrations between the carrier frame with the drive unit and the handle frame. A reliable take-up of the reaction forces, which act on the carrier frame and the operator, is ensured via the handle frame because the carrier frame is connected at several positions to the handle frame via respective coupling elements.

In a plan view of the handle frame, the carrier frame lies essentially within the handle frame so that grasping the handle sections for holding and guiding the work apparatus is not hindered by the carrier frame. The handle sections are provided on the handle frame.

The carrier frame is so configured that the support plate lies at a distance from the handle frame and this distance corresponds approximately to the elevation of the drive unit, that is, the total elevation of a drive unit with a drive motor. This affords the advantage that the entire drive unit lies essentially within the carrier frame and lies essentially below the plane of the carrier frame.

The carrier frame, which holds the carrier plate, preferably comprises two U-shaped carrier brackets. Each of the carrier brackets has leg ends which have respective end sections defining connecting ends which are held in the coupling element. Two coupling elements lie on longitudinal rods of the handle frame which lie opposite to each other. The rod of the handle frame projects through each coupling element so that a closed, stiff handle frame is formed. The coupling elements lie on longitudinal rods, which lie opposite each other; whereas, the handle sections are arranged on the opposite-lying transverse rods so that the coupling elements do not affect the arrangement of the handle sections.

Each coupling element has a coupling sleeve which engages around the handle frame. The vibration damper holds the handle frame on all sides at a distance within the coupling sleeve and preferably approximately coaxially. The vibration damper axially fixes the handle frame in the coupling sleeve and, for this purpose, the vibration damper is fixed on the rod of the handle frame so as not to be displaceable.

The vibration damper itself is configured as a disc-shaped or plate-shaped base body having a central assembly opening for the rod of the handle frame. The rod of the handle frame projects through the vibration damper approximately perpendicularly to the plane of the base body.

A buffer ring is arranged adjacent the vibration damper within the coupling sleeve and this buffer ring coacts with a counter stop in the coupling sleeve. The buffer ring is preferably configured to be cylindrical and has especially an end with a central assembly opening via which the buffer ring is fixed on the handle frame so as to be axially non-displaceable. The end having the central assembly opening has an approximately truncated conical shape. The buffer ring preferably is made of an elastic material and especially a hard elastic material.

The handle frame has an essentially rectangularly-shaped configuration and lies preferably in a plane. The carrier frame is connected to the handle frame via the coupling elements and is reinforced with an auxiliary frame in the region of the connecting ends of the carrier frame.

BRIEF DESCRIPTION OF THE DRAWINGS

The invention will now be described with reference to the drawings wherein:

FIG. 1 is a perspective view of a guide frame according to the invention and the guide frame is for an earth drilling apparatus;

FIG. 2 is a plan view on the guide frame of FIG. 1;

FIG. 3 is a view from below onto the guide frame;

FIG. 4 is a side elevation view of the guide frame;

DESCRIPTION OF THE PREFERRED EMBODIMENTS OF THE INVENTION

Figure 5:
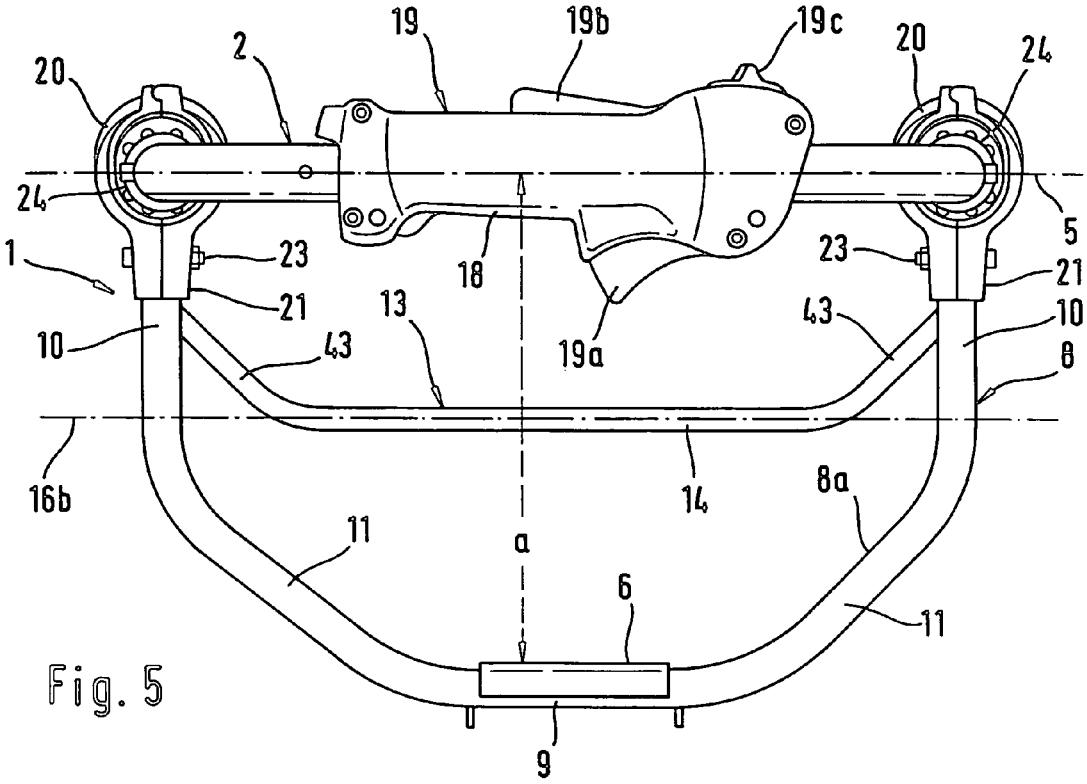
FIG. 5 is a side elevation view including a view of an operator-controlled handle.
Figure 6:
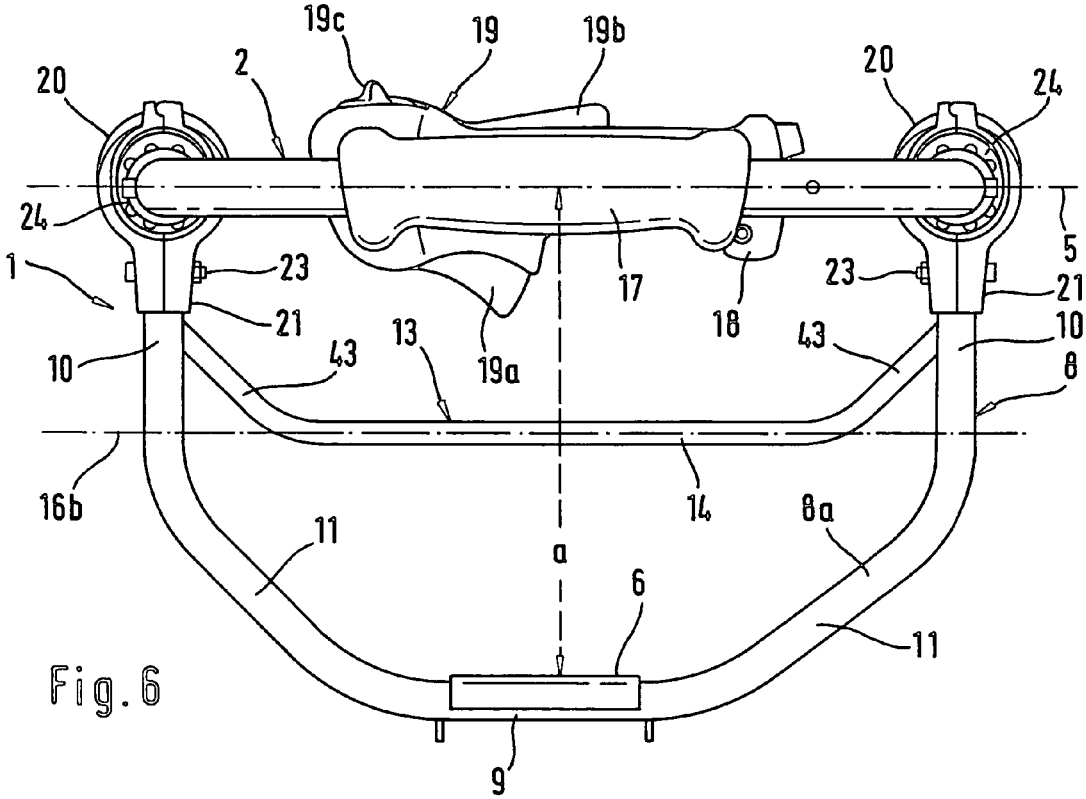
FIG. 6 is a side elevation view including a view of a handle section.

The guide frame shown in FIGS. 1 to 6 functions to hold and guide a work apparatus such as an earth drilling apparatus or the like as shown, for example, in U.S. Pat. No. 5,358,062.

The guide frame 1 essentially comprises a handle frame 2 which is essentially configured to have rectangular shape as shown in the plan view of FIG. 2. The handle frame has two longitudinal rods 3 as well as two transverse rods 4. The rectangularly-shaped handle frame 2 preferably lies in a plane 5 which lies at a spacing (a) to a support plate 6 as shown especially in FIGS. 4 to 6. The support plate 6 supports a drive unit 7 (FIG. 2) and lies, when viewed in plan onto the guide frame 1, approximately at the center of the rectangularly-shaped handle frame 2.

The support plate is held via a carrier frame 8 on the handle frame 2. The carrier frame 8 is preferably made up of two U-shaped carrier brackets (8*a*, 8*b*). The support plate 6 is fixed in the area of the struts 9 of the U-shaped carrier brackets (8*a*, 8*b*) and is aligned approximately parallel to the plane 5 of the handle frame 2. The end segments 10 of the carrier brackets (8*a*, 8*b*) are configured as connecting ends and, as shown in FIG. 4, these end segments are approximately at right angles to the plane 5 of the handle frame 2 and are fixed in receiving bushings 21 of a coupling element 20. The coupling element 20 is held on the handle frame 2. As shown in FIG. 4, the U-shaped brackets (8*a*, 8*b*) are angled toward each other so that the legs 11, which extend from the end sections 10, lie at an angle of less than 90° to the plane 5. In the embodiment shown, the angle 12 is approximately 60°.

The carrier frame 8 comprises the two carrier brackets (8*a*, 8*b*) and lies essentially within the handle frame 2 when viewed in plan toward the guide frame 1 (FIG. 2). The carrier frame 8 is reinforced by an auxiliary frame 13 in the region of the end sections 10 and this auxiliary frame is essentially quadratic when viewed in plan. The struts 14 of the auxiliary frame 13 extend parallel to the transverse rods 4 and these struts 14 lie at a greater distance from the plane 5 of the handle frame 2 than the struts 15 of the auxiliary frame 13. The struts 15 extend preferably below the longitudinal rods 3. The lateral struts 14 run parallel to each other and lie at an elevation offset to the struts 15 which run parallel to each other. The elevation offset is provided by spacer segments 43 and these spacer segments are integrated as one piece into the auxiliary frame 13 and form the corner regions of the frame. As shown in FIGS. 4 and 5, the higher-lying struts 15 of the auxiliary frame likewise lie in a common plane 16*a* as the struts 14 of the auxiliary frame 13 which are transverse to the handle frame 2. The struts 14 lie in a plane 16*b*. The plane 16*b* lies approximately centrally between the support plate 6 and the plane 5 of the handle frame 2; whereas, the plane 16*a* lies closer to the handle frame 2 than the plane 16*b*.

In the region of the transverse rods 4, and approximately centrally with respect to the individual rods 4, handle sections 17 and 18 are formed with the transverse rods 4 being disposed opposite each other. The handle section 18 is configured as an operator handle 19 for controlling the drive unit 7.

In the embodiment shown, the operator handle 19 has operator-controlled elements (19*a*, 19*b*, 19*c*) for controlling an internal combustion engine which can be part of the drive unit 7. A two-stroke engine and especially a two-stroke engine having advanced scavenging is preferred as an internal combustion engine. The arrangement of a mixture-lubricated four-stroke engine can be advantageous. The operator-controlled element 19*a* is configured as a throttle lever for actuating the throttle flap. The throttle lever 19*a* can only be actuated when the throttle lever lock 19*b* is depressed. The throttle lever lock 19*b* is mounted on the other side of the operator handle 19. A multifunction switch 19*c* is arranged in the head of the operator handle 19. This switch 19*c* functions as a short-circuit switch in a first position. In a second position, the switch 19*c* inputs the necessary throttle flap position for a warm start and, in a third position, the switch inputs the needed throttle flap position and, if needed, choke flap position for a cold start.

The operator holds the guide frame 1 at the handle sections (17, 18) which are attached to the opposite-lying transverse rods 4. In the embodiment shown, the operator handle 19 is arranged on the right hand side and is for persons who are right handed. An arrangement of the operator handle 19 on the left side for a left handed operator is easily possible because the connection to the internal combustion engine of the drive unit 7 is preferably via a Bowden cable 19*d*.

The support frame 8 is connected to the handle frame 2 in the region of the longitudinal rods 3. Two coupling elements are disposed on each of the two opposite-lying longitudinal rods 3 of the handle frame 2. A longitudinal rod 3 of the handle frame 2 projects through each coupling element 20. The handle frame 2 is configured as an assembled, closed frame, preferably as one piece. The longitudinal rods 3 are longer than the struts 15 of the auxiliary frame 13. For this reason, the handle sections (17, 18) lie at a greater lateral distance to the drive unit 7 so that the operator can reliably hold the guide frame with a reasonable amount of force while utilizing a long lever arm to the rotational axis 7*a* of the drive unit 7. Because of the longer longitudinal rods 3, it is furthermore ensured that an adequate distance is provided between the handle sections (17, 18) and the drive unit 7 or the support carrier frame 8 and the auxiliary frame 13. This distance forms a free space for the hands of the operator. It is advantageous that the rods 14 of the auxiliary frame 13 lie closer to the support plate 6 than do the struts 15. The hand of the operator is given adequate lateral free space in the region of the handle sections (17, 18).

Figure 7:
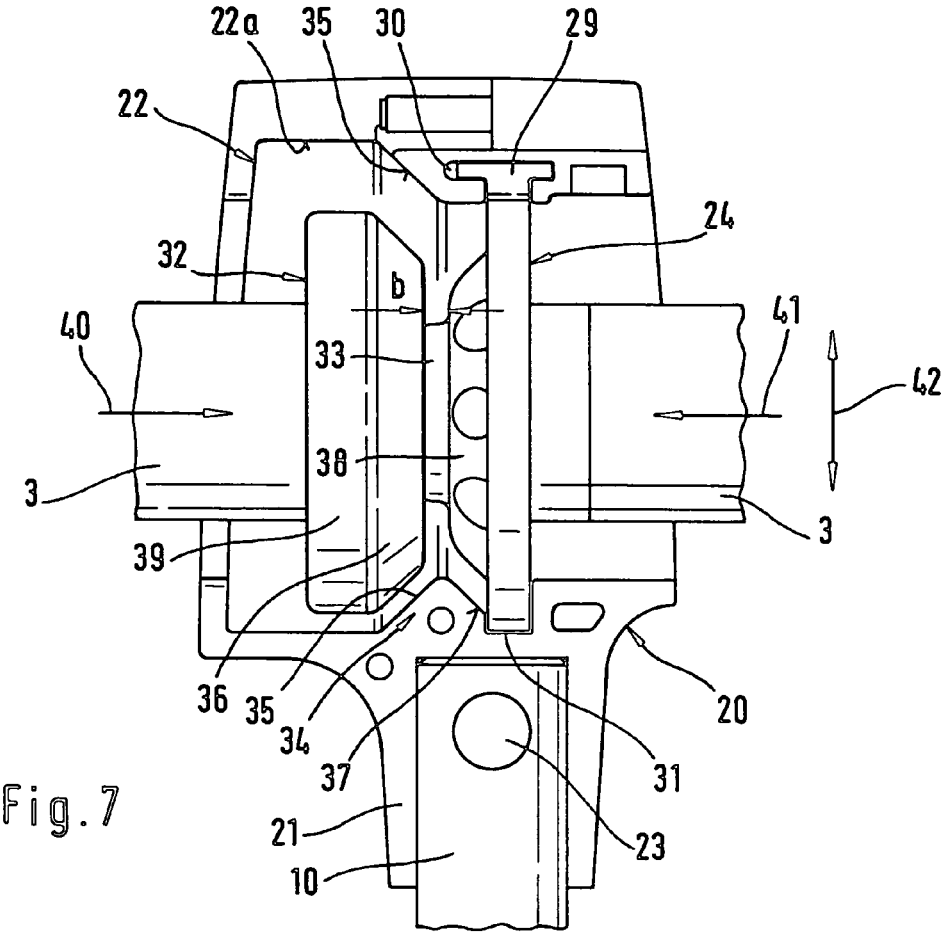
FIG. 7 is a section through a coupling element between the carrier frame and a handle frame.

FIG. 7 is a section taken through a coupling element 20. The coupling element 20 has an essentially T-shaped configuration. The perpendicular leg is formed by the receptacle bushing 21 and the horizontal leg is formed by a coupling sleeve 22 which surrounds the longitudinal rod 3 of the handle frame 2 at a distance about the entire periphery. The coupling sleeve 22 preferably engages around the longitudinal rod 3 approximately coaxially. The coupling sleeve 22 and the receptacle bushing 21 are configured as a common one-piece base body which can be produced from light metal such as aluminum, pressure-cast magnesium or also from plastic.

Each connecting end 10 of a bracket (8*a*, 8*b*) of the carrier frame 8 lies essentially free of play in the receptacle bushing 21 of the coupling element 20 and is unreleasably held by means of a through-projecting attachment bolt 23 which, for example, can be configured as a threaded fastener. The U-shaped carrier brackets (8*a*, 8*b*) extend approximately parallel to the transverse rods 4 so that the end sections 10 of a carrier bracket (8*a*, 8*b*) are fixed at opposite-lying longitudinal rods 3.

Figure 8:
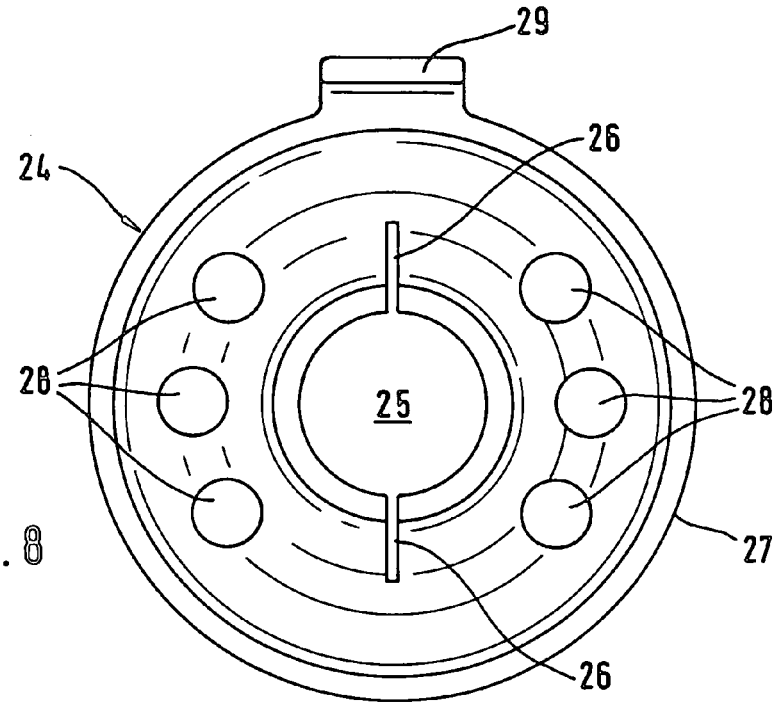
FIG. 8 is a view of a vibration damper mounted in a coupling element.
Figure 9:
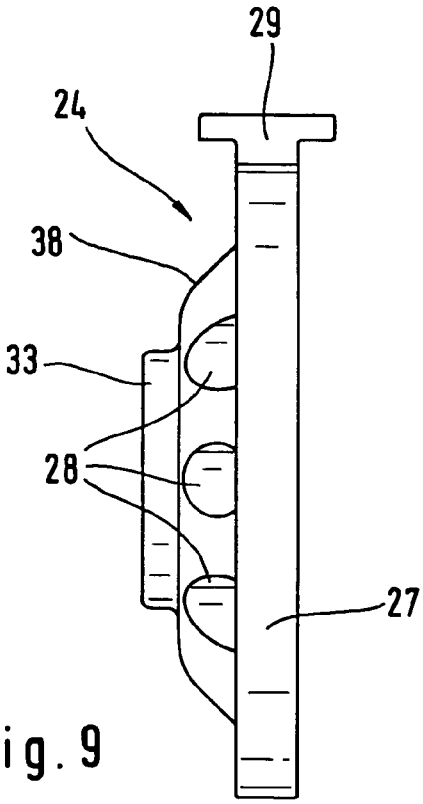
FIG. 9 is a side elevation view of a vibration damper of FIG. 8.

The connection between the longitudinal rod 3 of the handle frame 2 and the coupling element 20 takes place via a vibration damper 24 which, in the embodiment shown, has a plate-like or plate-spring shaped base body and is made out of a damping elastic material such as rubber. As FIG. 8 shows, the plate-spring shaped vibration damper 24 has an annularly-shaped peripheral edge 27 with a plate-like center portion having a central assembly opening 25 which has radial slits 26 lying on opposite sides as shown. Damping openings 28 are formed in the dish-like annular section between the central opening 25 and the outer periphery 27 of the plate-spring shaped vibration damper 24. These damping openings 28 coact to determine the vibration damping characteristics of the vibration damper 24. In the embodiment shown, the vibration damper 24 is configured to be symmetrical referred to the radial slit 26. Three damping openings 28 are arranged on each side of the radial slit 26 in the radial section. These damping openings 28 are at equal distances one from the other in the peripheral direction.

On the outer periphery 27, a T-shaped attachment flange 29 is formed over a part section. This T-shaped attachment flange 29 is provided for a form-tight engagement in a corresponding T-shaped receptacle 30 in the coupling sleeve 22 of the coupling element 20. In this way, the disc-shaped vibration damper 24 is fixed axially and radially captured in the coupling sleeve 22. The disc-shaped vibration damper 24 lies in a corresponding inner receptacle slot 31 of the coupling sleeve 22 over the outer periphery 27 whereby the position of the vibration damper 24 is secured within the coupling sleeve 22.

The longitudinal rod 3 of the handle frame 2 carries a cylindrical buffer ring 32 in addition to the vibration damper 24. The buffer ring 32 is made of a hard or hard-elastic material and is pushed onto the longitudinal rod 3 with a central opening 44. In order to facilitate assembly, two radial slits 45, which lie opposite each other, are introduced in the edge 46 of the opening 44. The buffer ring 32 is symmetrical to a plane determined by the radial slits 45.

Figure 11:
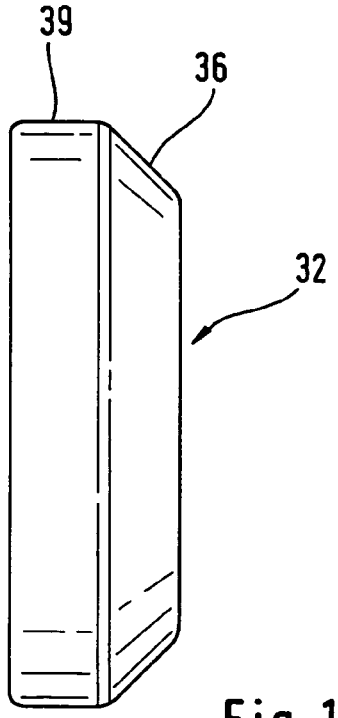
Figure 10:
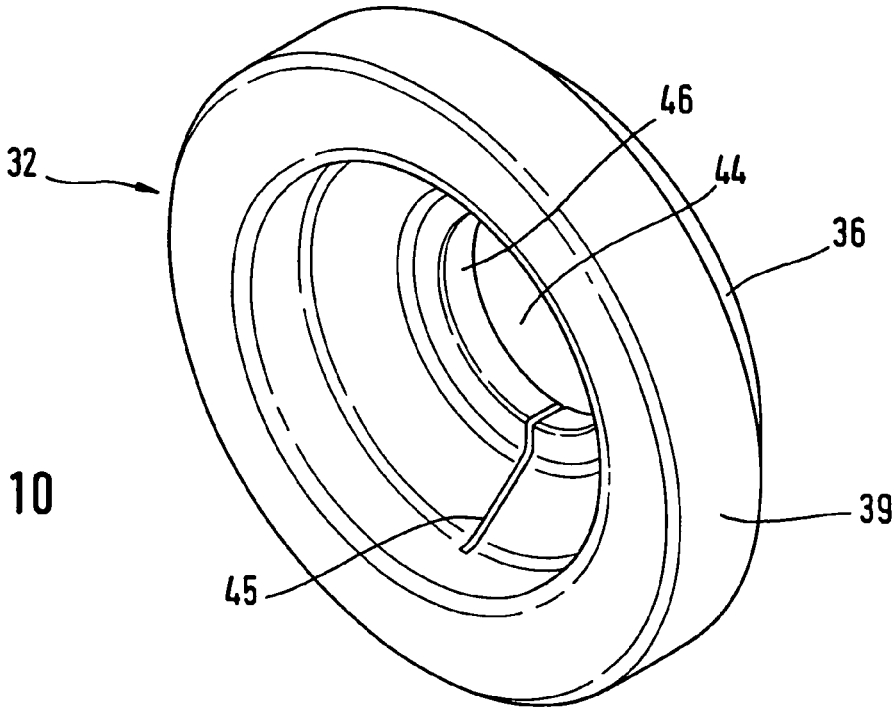
FIG. 10 is a perspective view of a buffer ring lying in the coupling element; and, FIG. 11 is a side view of the buffer ring of FIG. 10.

As FIGS. 10 and 11 show, the buffer ring 32 has a cylindrical base form similar to the vibration damper 24. One end of this cylindrical base form is tapered so as to have a truncated conical shape and has an assembly opening 44 with which the buffer ring 32 is fixed on the rod 3 of the handle frame 2 next to the vibration damper 24. The arrangement is so made that the dish-like base of the vibration damper 24 lies facing toward the conically-truncated shaped end of the buffer ring 32. To ensure a distance (b) between the vibration damper and the buffer ring 32, the vibration damper 24 has a cylindrical spacer flange 33 which is configured as one piece with the vibration damper 24. The buffer ring 32 and the vibration damper 24 are mutually adjacent on the longitudinal rod 3 and preferably axially fixed so as to be non-displaceable and are accommodated in the coupling sleeve 22.

In the coupling sleeve 22, a counter stop 34 is assigned to the buffer ring 32 and this counter stop is configured as a peripherally-extending inclined surface 35. The inclined surface 35 lies at a spacing to the conical surface 36 of the buffer ring 32 and lies especially parallel relative thereto. The counter stop 34 of the coupling sleeve 32 has a stop surface 37 on the end facing away from the inclined surface 35 and the stop surface 37 faces toward the arcuate center portion of the vibration damper 24 whereby the axial movement of the handle frame 2 in the direction of arrow 40 is limited by the buffer ring 32 and the counter stop 34 and, in the opposite direction 41, the axial movement is limited by the stop surface 37 and the plate-spring shaped vibration damper 24. In the radial direction 42, the load of the vibration damper 24 is limited by the buffer ring 32 which comes into contact engagement on the inner periphery 22*a* of the coupling sleeve 22 with a cylindrical outer surface 39 and thereby limits the radial deflection of the handle frame 2 relative to the carrier frame 8.

It is understood that the foregoing description is that of the preferred embodiments of the invention and that various changes and modifications may be made thereto without departing from the spirit and scope of the invention as defined in the appended claims.

What is claimed is:

1. A guide frame for a handheld work apparatus having a drive unit, the guide frame comprising:

a support plate for holding said drive unit on the guide frame;

a handle frame having handle sections to permit an operator to hold and guide said work apparatus;

an operator-controlled element arranged in the region of at least one of said handle sections for controlling said drive unit;

said handle sections conjointly defining a handle plane disposed above said support plate;

said handle frame being a closed frame surrounding said drive unit;

a carrier frame;

said handle frame being connected via said carrier frame to said support plate;

said handle frame having a plurality of coupling elements disposed thereon for attaching said carrier frame to said handle frame; and, each of said coupling elements including a vibration damper arranged between said carrier frame and said handle frame.

2. The guide frame of claim 1, wherein said carrier frame lies essentially within said handle frame when said handle frame is viewed in plan.

3. The guide frame of claim 1, wherein said support plate is at distance (a) from said handle plane and said distance (a) corresponds approximately to the height of said drive unit.

4. The guide frame of claim 1, wherein said carrier frame comprises two carrier brackets and each of said brackets has respective end sections defining connecting ends held in corresponding ones of said coupling elements.

5. The guide frame of claim 4, wherein each of said carrier brackets is a U-shaped carrier.

6. The guide frame of claim 5, wherein said handle frame comprises mutually opposite-lying longitudinal rods and each of said longitudinal rods accommodates two of said coupling elements thereon.

7. The guide frame of claim 6, wherein said handle frame further comprises mutually opposite-lying transverse rods and said handle sections are arranged on corresponding ones of said transverse rods.

8. The guide frame of claim 7, wherein each of said longitudinal rods extends through the coupling elements accommodated thereon.

9. The guide frame of claim 8, wherein each of said coupling elements includes a coupling sleeve for engaging around said handle frame; and, each of said vibration dampers is arranged so as to hold said handle frame at a distance on all sides thereof relative to the coupling sleeve of the coupling element corresponding thereto.

10. The guide frame of claim 9, wherein each of said vibration dampers axially fixes said handle frame in the coupling sleeve corresponding thereto.

11. The guide frame of claim 10, wherein each of said vibration dampers is fixed on the longitudinal rod corresponding thereto so as to be essentially non-displaceable.

12. The guide frame of claim 11, wherein each of said vibration dampers is configured to have a disc-shaped base body having a central assembly opening for accommodating the longitudinal rod corresponding thereto.

13. The guide frame of claim 12, wherein each of said longitudinal rods is perpendicular to the plane of the base body of each of the vibration dampers corresponding thereto.

14. The guide frame of claim 12, wherein each of said vibration dampers has a center portion configured to define a dish-like shape.

15. The guide frame of claim 9, wherein each of said coupling elements further comprises a counter stop in said coupling sleeve and a buffer ring assigned to the vibration damper to coact with said counter stop.

16. The guide frame of claim 15, wherein said buffer ring is configured to be cylindrical and to have an end having approximately a truncated conical shape and a central assembly opening.

17. The guide frame of claim 15, wherein said buffer ring is made of an elastic material.

18. The guide frame of claim 17, wherein said material is a hard elastic material.

19. The guide frame of claim 1, wherein said handle frame has an essentially rectangular configuration and lies in a plane.

20. The guide frame of claim 4, further comprising an auxiliary frame for reinforcing said carrier frame in the region of said connection thereof.

* * * * *